United States Patent [19]

Akashi et al.

[11] 4,173,482

[45] Nov. 6, 1979

[54] DRY IMAGE FORMING MATERIAL CONTAINING AN ORGANIC SILVER SALT OXIDIZING AGENT, A REDUCING AGENT AND A HALOGEN MOLECULE

[75] Inventors: Kageyasu Akashi; Yoshio Hayashi; Tatsumi Arakawa; Takeo Kimura; Hidehiko Kobayashi, all of Fuji, Japan

[73] Assignee: Asahi Kasei Kogyo Kabushiki Kaisha, Osaka, Japan

[21] Appl. No.: 884,529

[22] Filed: Mar. 8, 1978

[30] Foreign Application Priority Data

| | | | |
|---|---|---|---|
| Mar. 16, 1977 | [JP] | Japan | 52-28088 |
| Mar. 16, 1977 | [JP] | Japan | 52-28089 |
| Jun. 14, 1977 | [JP] | Japan | 52-69424 |

[51] Int. Cl.[2] ..... G03C 1/02

[52] U.S. Cl. ..... 430/619; 430/567; 430/608

[58] Field of Search ..... 96/114.1, 107, 48 HD, 96/88, 109; 428/913

[56] References Cited

U.S. PATENT DOCUMENTS

| | | | |
|---|---|---|---|
| 3,594,172 | 7/1971 | Sincius | 96/107 |
| 3,764,329 | 10/1973 | Lee | 96/114.1 |
| 3,802,888 | 4/1974 | Willis | 96/114.1 |
| 4,003,749 | 1/1977 | Masuda et al. | 96/114.1 |
| 4,021,250 | 5/1977 | Sashihara et al. | 96/114.1 |

*Primary Examiner*—Won H. Louie, Jr.

*Attorney, Agent, or Firm*—Sprung, Felfe, Horn, Lynch & Kramer

[57] ABSTRACT

A dry image forming material comprising (a) a non-photosensitive organic silver salt oxidizing agent, (b) a reducing agent for a silver ion and (c) a halogen molecule, which material is excellent in that a high sensitivity can be obtained and the occurrence of fog is extremely small. The sensitivity can be further improved by incorporation of a halogen ion source in addition to the halogen molecule. Furthermore, the dry image forming material can be improved, with respect to light stability of the raw image forming material and stabilities to heat and humidity, by incorporation of a nickel compound and/or a cobalt compound. In the dry image forming material of this invention, further incorporation of a carboxylic acid anhydride exerts a remarkable anti-fogging effect. The dry image forming material of this invention is non-photosensitive under normal lighting conditions and therefore, can be prepared, handled and stored in a light room. An image can be easily, simply formed only by preliminary heating, light exposure and heat development of the image forming material.

8 Claims, No Drawings

DRY IMAGE FORMING MATERIAL CONTAINING AN ORGANIC SILVER SALT OXIDIZING AGENT, A REDUCING AGENT AND A HALOGEN MOLECULE

This invention relates to a novel dry image forming material. More particularly, this invention relates to a dry image forming material which is non-photosensitive under normal lighting conditions but is rendered photosensitive by heating and which can record thereon an image only by a dry process (hereinafter referred to as "normally non-photosensitive image forming material").

Photosensitive materials comprising a silver halide as the main ingredient, which have heretofore been conventionally used, need complicated processes for formation of images thereon. Accordingly, a considerable skill is necessary for obtaining a good result when an image is formed on such silver halide photosensitive materials. For this reason, there have been made many attempts to develop improved photosensitive materials which can simplify the image forming process. For example, as a photosensitive material on which an image can be formed only by a dry process, there has been proposed a silver salt type photosensitive material comprising an organic silver salt oxidizing agent, a reducing agent for reducing a silver ion and a catalytic amount of a silver halide. However, the proposed photosensitive material is photosensitive under normal lighting conditions and is defective in that it cannot be handled in a light room.

With a view to obviating this defect, there have been proposed normally non-photosensitive image forming materials, but they have various defects and hence none of them have been put into practical use. For example, there is proposed in U.S. Pat. No. 3,764,329 a sheet material comprising a organic silver salt oxidizing agent, a reducing agent and an organic haloamide, but the proposed material is defective in that it does not have sensitivity sufficient for practical use.

As a result of our extensive researches with a view to developing a normally non-photosensitive dry image forming material which can be put into practical use, we have now completed this invention.

In accordance with this invention, there is provided a dry image forming material comprising (a) a non-photosensitive organic silver salt oxidizing agent, (b) a reducing agent for a silver ion and (c) at least one halogen molecule selected from the group consisting of a bromine molecule, a iodine molecule, iodine chlorides (iodine monochloride and iodine trichloride), iodine bromide and bromine chloride.

According to this invention, by the use of a specific halogen molecule, a normally non-photosensitive dry image forming material having a practical sensitivity can be provided, and even if an anti-foggant is not used, the occurrence of fog in a non-exposed area of the material is extremely small.

The dry image forming material of the present invention which comprises as essential ingredients only the above-mentioned three ingredients, i.e., (a) an organic silver salt oxidizing agent, (b) a reducing agent for a silver ion and (c) at least one halogen molecule as specified above, has a sufficient sensitivity from the practical point of view. In this connection, it is noted that the dry image forming material of the present invention can be further improved by using (d) a halogen ion source in combination with the above-mentioned halogen molecule to provide a dry image forming material having a higher sensitivity without sacrifice of storage stability. It is believed that the halogen ion source added with such purpose reacts in part with the organic silver salt oxidizing agent at the preparation of the emulsion and/or reacts with said oxidizing agent at the preliminary heating to form a silver halide whereby the sensitivity is improved.

Furthermore, in accordance with the present invention, the dry image forming material comprising the ingredients (a), (b) and (c) or (a), (b), (c) and (d) can be remarkably improved, with respect to stability to light, especially light stability of the raw image forming material, and stabilities to heat and humidity, by further incorporating thereinto at least one metallic compound selected from the group consisting of nickel compounds and cobalt compounds.

As the non-photosensitive organic silver salt oxidizing agent that may be used in this invention, silver salts of long chain fatty acids having 12 to 24 carbon atoms, such as silver laurate, silver myristate, silver palmitate, silver stearate, silver arachidate and silver behenate, are especially preferred. Other non-photosensitive silver salts can also be used in the present invention. Examples of such non-photosensitive silver salts include silver salts of organic compounds having an imino group, such as benztriazole silver salt, benzimidazole silver salt, carbazole silver salt and phthalazinone silver salt; silver salts of sulfur-containing compounds, such as silver S-alkylthioglycollates; silver salts of aromatic carboxylic acids, such as silver benzoate and silver phthalate; silver salts of sulfonic acids, such as silver ethanesulfonate; silver salts of sulfinic acids, such as silver o-toluene sulfinate; silver salts of phosphoric acid derivatives, such as silver phenylphosphate; silver barbiturate; silver saccharinate; and salicylaldoxime silver salt. They may be used alone or in mixture. The organic silver salt may be used in an amount of about 0.1 to about 50 g/m$^2$, preferably 1 to 10 g/m$^2$ of the support area of the dry image forming material.

The silver ion reducing agent that may be suitably used for the image forming material of this invention is a hindered phenol in which one or two sterically bulky groups are bonded to the carbon atom or carbon atoms contiguous to the hydroxyl group-bonded carbon atom to sterically hinder the hydroxyl group. The hindered phenol has a high stability to light and hence, the use of the hindered phenol is significant in the normally non-photosensitive image forming material for securely maintaining the light stability of the raw image forming material and the stability against post-fogging. As examples of such hindered phenols, there can be mentioned 2,6-di-tert-butyl-4-methylphenol, 2,2'-methylenebis(4-methyl-6-tert-butylphenol), 2,6-methylenebis(2-hydroxy-3-tert-butyl-5- methylphenyl)-4-methylphenol, 2,2'-methylenebis(4-ethyl-6- tert-butylphenol), 2,4,4-trimethylpentylbis(2-hydroxy-3,5- dimethylphenyl)methane, 2,2'-methylenebis[4-methyl-6-(1-methylcyclohexyl)phenol]and 2,5-di-tert-butyl-4-methoxyphenol. As the silver ion reducing agent in the present invention, there may alternatively be used reducing agents for conventional wet process silver salt type photosensitive materials, such as hyroquinone, 2,5-dimethylhydroquinone, chlorohydroquinone, p-aminophenol, α-naphthol, β-naphthol, 1,3-dihydroxynaphthalene, phenidone and methyl gallate, and there can further be used p-phenylphenol, bisphenol A, 2,4-dihydroxybenzoic acid, p-methoxyphenol, tert-butylhydroquinone and 2,2'-dihydroxy-1,1'-binaphthyl. They may be used alone or in mixture. A suitable reducing agent may be chosen depending on the organic silver salt oxidizing agent employed in combination therewith. For example, when there is employed as the oxidizing agent a long chain fatty acid silver salt such as silver behenate which is relatively hard to reduce, a relatively strong reducing agent, e.g., a bisphenol such as 2,2'-methylenebis(4-ethyl-6-t-butyl) phenol is suitably employed. On the other hand, to organic silver salt oxidizing agents such as silver laurate which are relatively easy to reduce are suitable relatively weak reducing agents, e.g., substituted phenols such as p-phenylphenol and to organic silver salt oxidizing agents such as benzotriazole silver salt which are very hard to reduce are suitable strong reducing agents such as ascorbic acids. The reducing agent may be used in an amount of 0.1 to 200% by weight, preferably 1 to 100% by weight, based on the amount of the organic silver salt oxidizing agent.

Of the aforementioned five kinds of halogen molecules, bromine chloride is used preferably in the form of a hydrate which is solid. The term "halogen molecule" used herein is intended to include not only the defined halogen molecule itself but also a complex of the halogen, for example, a complex thereof with p-dioxane. Such complexes are generally solid. Of the halogen molecules that may be used in this invention, an iodine molecule which is solid under normal conditions is most preferred. In general, the halogen molecule may be used in an amount of about 0.1 to 40% by weight, preferably about 1 to about 20% by weight, based on the amount of the organic silver salt oxidizing agent.

As the halogen ion source in the dry image forming material of this invention, any of compounds capable of generating a halogen ion may be used. Examples of such halogen ion sources include calcium iodide, barium iodide, rubidium iodide, cesium iodide, aluminum iodide, magnesium iodide, sodium iodide, potassium iodide, bromides and chlorides corresponding to the above-mentioned iodides, and quaternary tetraalkyl ammonium salts such as tetraethyl ammonium salts, quaternary aralkyl trialkyl ammonium salts such as benzyl trimethyl ammonium salts and quaternary aryl trialkyl ammonium salts such as phenyl trimethyl ammonium salts, said quaternary ammonium salts being those of hydroiodic acid, hydrobromic acid and hydrochloric acid. Further examples of the halogen ion source include ionizable organic halogen compounds such as triphenylmethyl iodide and phenacyl bromide; nonmetallic halogen compounds such as triphenylphosphine diiodide, triphenylphosphine dibromide, triphenylphosphite diiodide and triphenylphosphite dibromide; halogen-containing organometallic compounds such as titanocene dichloride, zirconocene dichloride, dimethylsilyl dichloride, trimethylsilyl chloride and triphenylgermanium bromide. These compounds to be used as the halogen ion source may be used alone or in combination. The amount of the halogen ion source to be used may be about 0.1 to about 20 mole %, preferably 0.5 to 10 mole %, based on the amount of the organic silver salt oxidizing agent.

The halogen ion source and the halogen molecule may be added separately, or a compound or compounds capable of forming a halogen ion source and a halogen molecule by reaction at the preparation of the image forming material may be used. Following is an explanation of the illustrative mode of use of a combination of the halogen ion source and an iodine molecule in the form of a compound or compounds described above. The explanation is made exemplifying the use of iodine as the halogen. For example, triphenylphosphite diiodide and iodine molecule can be formed by the use of triphenyl phosphite and an excessive amount of molecular iodine. Also, triphenylphosphite nonaiodide as synthesized according to the method disclosed in J. Am. Chem. Soc., 75, p. 3145 (1953) is dissociated into triphenylphosphite diiodide and molecular iodine at the time of the preparation of the composition for the image forming material, even when it is used alone. When this triphenylphosphite nonaiodide is employed, there is obtained an image forming material having a good storage stability and a good sensitivity, and hence, the use of triphenylphosphite nonaiodide is preferred.

As representative examples of combinations of compounds, there can be mentioned combinations of molecular iodine and phosphites such as alkyl phosphites, e.g., tributyl phosphites and tristearyl phosphite, and aryl phosphites, e.g., triphenyl phosphite and tricresyl phosphites. Also, there may be used, for example, combinations of molecular iodine and selenides such as alkyl selenides, e.g., dibutyl selenides, and aryl selenides, e.g., diphenyl selenide; combinations of molecular iodine and tellurides such as alkyl tellurides, e.g., dibutyl tellurides, and aryl tellurides, e.g., diphenyl telluride; and combinations of molecular iodine and arsines such as alkylarsines, e.g., tributylarsines, and arylarsines, e.g., triphenylarsine. The above explanation is made with respect to the case where iodine is used as a halogen, but the similar combinations may be used with respect to the case of other halogen molecules.

As the cobalt compound and/or the nickel compound in the dry image forming material of this invention, there can be used a wide variety of inorganic cobalt compounds and nickel compounds and coordination compounds consisting of cobalt or nickel as the central metal and a ligand. From the viewpoints of good solubility in the solvent at the preparation of the emulsion and of good compatibility with the binder in the case where the binder is used, there are preferably used inorganic compounds such as nickel perchlorates and cobalt perchlorates, and coordination compounds including a $\beta$-diketone, an oxine, an oxime, dithiocarbamic acid, salicylaldehyde, salicylaldoxime, ammonia, pyridine, glycine, xanthogenic acid, o-phenanthroline or the like as the ligand. As specific examples of the above-mentioned coordination compounds, there can be mentioned acetylacetonatocobalt (II), acetylacetonatocobalt (III), tris(8-hydroxyquinolato)cobalt (III), trisglycinatocobalt (III), cobalt (III) diethyldithiocarbamate, tris(dimethylglyoximato)cobalt (III), bissalicylaldoximatonickel (II), cobalt (III) ethylxanthogenate, hexamminecobalt (III) acetate, bissalicylaldehydatonickel (II), bissalicyladehydatocobalt (II), acetylacetonatonickel (II), hexamminenickel (II) perchlorate, hexapyridinenickel (II) perchlorate and tris-o-phenanthrolinecobalt (III) nitrate.

Cobalt halides such as cobalt chlorides, cobalt bromides and cobalt iodides and nickel halides such as nickel chlorides, nickel bromides and nickel iodides are preferred because they function not only as the halogen ion source capable of imparting a high sensitivity but also as the cobalt or nickel compound capable of imparting a light stability. They may be used alone or in mixture. In this invention, the cobalt compound and/or the nickel compound may be used in an amount of 0.005 to 0.5 mole, preferably 0.01 to 0.1 mole, per mole of the halogen molecule.

In this invention, a practically useful image forming material can be prepared even if an anti-foggant is not particularly added. If a higher anti-fogging effect is required, an anti-foggant may, of course, be used in this invention. As the anti-foggant, there can be mentioned mercury salts, palladium salts, benztriazoles, phenylmercaptotetrazoles and a wide variety of acidic compounds. For example, when mercury acetate is used as the anti-foggant in an amount as small as about 0.01 mole % based on the amount used of the organic silver salt oxidizing agent, a remarkable anti-fogging effect can be attained in a dry image forming material of this invention. Also, carboxylic acid anhydrides impart a remarkable anti-fogging effect to the dry image forming material of the present invention. As the carboxylic acid anhydrides, there can be mentioned HET anhydride (chlorendic anhydride), trimellitic acid anhydride, phthalic anhydride, camphoric anhydride, cyclohexanedicarboxylic anhydride, succinic anhydride, tetrabromophthalic anhydride, tetrachlorophthalic anhydride and the like. They may be used alone or in mixture. Of them, tetrachlorophthalic anhydride has a highest anti-fogging effect and is most preferred. The carboxylic acid anhydride may be used in an amount of 0.05 to 10 mole %, based on the amount of the organic silver salt oxidizing agent.

A dry image forming material of this invention may further comprise modifiers such as a binder for film formation, a toner for a silver image and a background-darkening preventing agent in addition to the foregoing ingredients, according to need.

The binder is needed for film formation in most cases, but when the organic silver salt oxidizing agent and/or the reducing agent has the function as a binder, the use of a binder may be omitted. As representative examples of the film-forming binder, there can be mentioned polyvinyl acetate, vinyl chloride-vinyl acetate copolymers, polyvinyl chloride, polyvinyl butyral, polymethyl methacrylate, cellulose acetate, cellulose acetate propionate, cellulose acetate butyrate, polyvinyl alcohol, polyvinyl pyrrolidone, gelatin and polystyrene. They may be used alone or in mixture. It is preferred and suitable that the film-forming binder be used in such an amount that the weight ratio of the binder to the organic silver salt oxidizing agent is in the range of from about 0.1 to about 10. As the toner for a silver image, there can be mentioned, for example, phthalazinone, benzoxazidinedione, cyclic imides, quinazolinone, 2-pyrazoline-5-one, zinc acetate and cadmium acetate. The toner may be used suitably in an amount of 0.01 to 1 mole per mole of the organic silver salt oxidizing agent.

As the background-darkening preventing agent, there can be mentioned, for example, tetrabromobutane, hexabromocyclohexane and tribromoquinaldine. This agent may be used suitably in an amount of 2.5 to 14 mole % based on the organic silver salt oxidizing agent.

The preferred method of preparing the dry image forming material of this invention is described by way of example as follows. An organic silver salt oxidizing agent as prepared separately is dispersed in a binder solution or emulsion for a photographic emulsion by means of a sand grinder, a mixer, a ball mill or the like. To the resulting dispersion are, in turn, added additives such as a halogen molecule, a reducing agent and the like. The thus obtained composition is applied onto a support such as a plastic film, a glass plate, a paper or a metal plate to prepare a dry image forming material. As the plastic film, there can be mentioned, for example, cellulose triacetate and other cellulose acetate films, polyethylene terephthalate and other polyester films, polyamide films, polyimide films, a polyvinyl acetal film, a polystyrene film, a polyethylene film and polycarbonate films. As the paper, there can be mentioned, for example, a photographic base paper, a coated paper, an art paper, a barite paper and a waterproof paper as well as ordinary papers. An aluminum plate can be used as a metal plate by way of example. The dry thickness of the coating is 1 to 1,000$\mu$, preferably 3 to 20$\mu$. The ingredients of the composition may be applied and laminated separately in two or more layers, optionally. The so prepared sheet material is non-photosensitive under normal lighting conditions and it can be handled in a light room. When a given area of this sheet material is heated in the dark, this area is rendered photosensitive. This preliminary heating is preferably carried out at a temperature of 90° to 200° C. If the heating temperature is elevated, the heating time may be proportionally short. When the area rendered photosensitive by heating is exposed imagewise to light and then heat-developed, a visible image is obtained. It is preferred that heat development be carried out at a temperature of 90° to 200° C. The heating period of time at either preliminary heating or heat development may be controlled within the range of from 1 to 60 seconds. When the preliminary heating for rendering the material photosensitive and the heat development are conducted at the same temperature, the time for the heat development is generally longer than the time for the preliminary heating. In the image forming material of this invention, a visible image can be recorded selectively on a given area, and up-dated informations may be additionally recorded on other area according to need.

This invention will now be described in more detail by reference to the following Examples that by no means limit the scope of the invention.

EXAMPLE 1

To 22 g of a mixed solvent of toluene and methyl ethyl ketone (the mixing weight ratio being 1:2) was added 3 g of silver behenate, and the mixture was ball-milled for about 18 hours to obtain a homogeneous silver behenate suspension [A].

To 1.5 g of the silver behenate suspension [A] were successively added ingredients [I] as shown below to form a light yellow silver behenate emulsion [BI]. The silver behenate emulsion [BI] was uniformly applied onto a 100$\mu$-thick polyester film at an orifice of 100$\mu$, and the coating was air-dried at room temperature (about 20° C.) to obtain a dry image forming material having a dry coating layer thickness of about 8$\mu$ (the preparation of this image forming material was conducted in a light room all the time).

Ingredients [I]

Solution of 7.2 g of polyvinyl butyral in 80 g of methyl ethyl ketone—1.0 g

Iodine (finely pulverized in an agate mortar)—16 mg

Phthalazinone—15 mg 2,6-Methylenebis(2-hydroxy-3-tert-butyl-5-methylphenyl)-4-methylphenol—20 mg The so obtained dry image forming material was heated on a hot plate maintained at about 100° C. for 5 seconds in a dark room to render it photosensitive. Then, the material was closely contacted with a mask film and exposed to light from a 150-watt xenon lamp for 1 second. When the exposed material was heated on a hot plate maintained at about 120° C. for about 5 seconds in a dark room, a negative image was gradually developed during heating.

The image was characterized by a maximum optical density (O.D. max) of 1.21 and a minimum optical density (fog density, O.D. min) of 0.06.

On the other hand, when the dry image forming material was exposed to light from a 150-watt xenon lamp for 1 minute without preliminary heating and it was then heated on a hot plate maintained at about 120° C. for about 10 seconds in the dark, no image was developed.

EXAMPLE 2

A dry image forming material was prepared in the same manner as described in Example 1 except that 1 mg of iodine was used instead of 16 mg of iodine. The obtained image forming material was subjected to preliminary heating, light exposure and heat development in the same manner as described in Example 1 to obtain an image having a maximum optical density (O.D. max) of 0.68 and a minimum optical density (O.D. min) of 0.05.

EXAMPLE 3

A dry image forming material was prepared in the same manner as described in Example 1 except that 50 mg of iodine were used instead of 16 mg of iodine. The obtained image forming material was subjected to preliminary heating, light exposure and heat development in the same manner as described in Example 1 to obtain an image having a maximum optical density (O.D. max) of 0.77 and a minimum optical density (O.D. min) of 0.08.

EXAMPLE 4

A dry image forming material was prepared in the same manner as described in Example 1 except that, instead of silver behenate, silver stearate was used in the same amount by weight as that of silver behenate used in Example 1. The obtained image forming material was subjected to preliminary heating, light exposure and heat development in the same manner as described in Example 1 to obtain an image having a maximum optical density (O.D. max) of 1.42 and a minimum optical density (O.D. min) of 0.08.

EXAMPLE 5

A dry image forming material was prepared in the same manner as described in Example 1 except that, instead of silver behenate and 2,6-methylenebis(2-hydroxy-3-tert-butyl-5-methylphenyl)-4-methylphenol, benztriazole silver salt and tert-butylhydroquinone were used respectively in the same amounts by weight as those of the corresponding agents used in Example 1. The obtained image forming material was subjected to preliminary heating, light exposure and heat development in the same manner as described in Example 1 to obtain an image having a maximum optical density (O.D. max) of 0.56 and a minimum optical density (O.D. min) of 1.10.

EXAMPLE 6

An image forming material was prepared using bromine-p-dioxane complex (isolated as a light yellow solid) as a halogen molecule.

More specifically, ingredients [II] as shown below were successively added to 1.5 g of the silver behenate suspension [A] prepared in Example 1 to form a silver behanate emulsion [BII]. This emulsion was uniformly applied onto a 100μ-thick polyester film at an orifice of 100μ, and the coating was sufficiently air-dried at room temperature (20° C.) for about 2 hours.

Ingredients [II]

Solution of 7.2 g of polyvinyl butyral in 80 g of methyl ethyl ketone—1.0 g

Bromine-p-dioxane complex—15 mg

About 2 g of a reducing agent layer composition composed of ingredients [III] as shown below were uniformly applied as a second layer onto the dried film of the coating of the silver behenate emulsion [BII] at an orifice of 100μ and the coating was air-dried at room temperature (20° C.) to obtain an image forming material having a total coating layer thickness of about 12μ.

Ingredients [III]

Cellulose acetate—6.3 g 2,2'-Methylenebis(4-methyl-6-tert-butylphenol)—3.4 g

Phthalazinone—1.4 g

Acetone—83 g

The so obtained dry image forming material was heated on a hot plate maintained at about 100° C. for 5 seconds in a dark room to render it photosensitive. The material was closely contacted with a mask film and was exposed to light from a 150-watt xenon lamp for 1 second. The exposed material was then heated on a hot plate maintained at about 120° C. for about 5 seconds. A black negative image was gradually developed during heating.

The black image was characterized by a maximum optical density (O.D. max) of 0.75 and a minimum optical density (fog density, O.D. min) of 0.09.

On the other hand, when the dry image forming material was exposed to light from a 150-watt xenon lamp for 1 minute without preliminary heating and it was heated on a hot plate maintained at about 120°0 C. for about 10 seconds in the dark, no image was developed.

EXAMPLE 7

A dry image forming material was prepared in the same manner as described in Example 6 except that 10 mg of bromine was used instead of bromine-p-dioxane complex. The obtained image forming material was subjected to preliminary heating, light exposure and heat development in the same manner as described in Example 6 to obtain an image having a maximum optical density (O.D. max) of 0.41 and a minimum optical density (O.D. min) of 0.06.

EXAMPLE 8

An image forming material was prepared using iodine bromide (IBr) as a halogen molecule.

More specifically, ingredients [IV] as shown below were successively added to 1.5 g of the silver behenate suspension [A] prepared in Example 1 to form a silver behenate emulsion [BIV]. This silver behenate emuslion was uniformly applied onto a 100μ thick single-sided art paper at an orifice of 75μ and air-dried at room temperature (20° C.) to prepare a dry image forming material having a dry coating layer thickness of about 7μ.

Ingredients [IV]

Solution of 7.2 g of polyvinyl butyral in 80 g of methyl ethyl ketone—1.0 g
Iodine bromide—15 mg
Phthalazinone—15 mg
2,6-Di-tert-butyl-p-cresol—25 mg The so prepared dry image forming material (dry heat-sensitive photosensitive paper) was passed through hot rolls silicone rubber-covered rolls) heated at about 100° C. over a period of about 4 seconds in a dark room to render the material photosensitive. The material was then closely contacted with a mask film and exposed to light from a 150-watt xenon lamp for 2 seconds. The dry image forming material was then passed through the above hot rolls heated at about 125° C. over a period of 4 seconds to obtain a clear negative image.

EXAMPLE 9

A dry image forming material was prepared in the same manner as described in Example 8 except that bromine chloride hydrate ($BrCl.4H_2O$) was used in an amount of 15 mg in terms of bromine chloride, instead of 15 mg of iodine. The obtained image forming material was subjected to preliminary heating, light exposure and heat development in the same manner as described in Example 8 to obtain a clear negative image.

EXAMPLE 10

A dry image forming material was prepared in the same manner as described in Example 8 except that 12 mg of iodine monochloride was used instead of 15 mg of iodine. The obtained image forming material was subjected to preliminary heating, light exposure and heat development in the same manner as described in Example 1 to obtain a clear negative image.

EXAMPLE 11 AND COMPARATIVE EXAMPLE 1

In order to demonstrate the effect of iodine as an essential ingredient in this invention, the following experiments were carried out to compare the effect of iodine with that of N-bromosuccinimide. Namely, the following ingredients [V] were mixed to form coating compositions.

Ingredients [V]

Silver behenate suspension [A] prepared in Example 1—1.5 g
Polyvinyl butyral solution as used in Example 1—1.0 g
Iodine or N-bromosuccinimide—indicated in Table 1
Phthalazinone—15 mg
Mercury acetate—indicated in Table 1
2,2'-Methylenebis(4-ethyl-6-tert-butylphenol)—25 mg In the ingredients [V], iodine or N-bromosuccinimide and mercury acetate were incorporated in given amounts as shown in Table 1. Procedures for the preparation of image forming materials were the same as those described in Example 1.

Table 1

| Experiment No. | Iodine or N-Bromosuccinimide | Mercury Acetate | Remarks |
|---|---|---|---|
| 1 | iodine, 14 mg | 0 mg | this invention |
| 2 | iodine, 14 mg | 0.1 mg | " |
| 3 | iodine, 14 mg | 1 mg | " |
| 4 | N-bromosuccinimide, 20 mg | 0 mg | comparative |
| 5 | N-bromosuccinimide, 20 mg | 0.1 mg | " |
| 6 | N-bromosuccinimide, 20 mg | 1 mg | " |
| 7 | N-bromosuccinimide, 20 mg | 5 mg | " |

Each of the so obtained materials was subjected to preliminary heating in the same manner as described in Example 1, and then exposed to light from a 150-watt xenon lamp so that the maximum optical density (O.D. max) thereof was 1.0. Then, the exposed materials were heat-developed and image characteristics were evaluated. On the other hand, the raw image forming materials were stored in a room (under an artificial light of about 1500 luxes) to examine the stability. The obtained results are shown in Table 2.

Table 2

| Experiment No. | Quantity of Exposure Light Necessary for Obtaining Maximum Optical Density (O.D. max) of 1.0* | Fog Density (O.D. min) | Stability of Raw Image Forming Material** | Remarks |
|---|---|---|---|---|
| 1 | 1 | 0.08 | slight increase of fog density after 3 months (0.16) | this invention |
| 2 | 1 | 0.06 | no substantial change after 3 months | this invention |
| 3 | 1 | 0.05 | no substantial change after 3 months | this invention |
| 4 | 5 | 0.17 | increase of fog density after 1 week (0.41) | comparative |
| 5 | 5 | 0.10 | increase of fog density after 1 month (0.35) | comparative |
| 6 | 6 | 0.09 | slight increase of fog density after 1 month (0.17) | comparative |
| 7 | 6 | 0.10 | slight increase of fog density after 3 months (0.15) | comparative |

*:Relative value calculated based on the assumption that the quantity of exposure light necessary for obtaining O.D. max value of 1 in Experiment 1 was 1.
**:Parenthesized value indicates the minimum optical density (O.D. min) after storage.

In the foregoing experiments, the values of optical density were evaluated after exposure to light from a 150-watt xenon lamp and subsequent development by heating on a hot plate maintained at 120° C. for 5 seconds.

From the results shown in Table 2, it will readily be understood that the dry image forming materials according to this invention have high sensitivities and mercury acetate exerts a very high effect to the dry image forming material of this invention even if it is incorporated in a very small amount.

EXAMPLE 12 AND COMPARATIVE EXAMPLE 2

Ingredients [VI] as shown below were successively added to 1.5 g of the silver behenate suspension [A] prepared in Example 1 to form a light yellow silver behenate emulsion. The emulsion was uniformly applied onto a 100μ-thick polyester film at an orifice of 100μ. The coating was air-dried at room temperature (about 20° C.) to obtain a dry image forming material having a dry coating layer thickness of about 8μ.

Ingredients [VI]

Solution of 7.2 g of polyvinyl butyral in 80 g of methyl ethyl ketone—1.0 g
Iodine (finely pulverized in a mortar)—14 mg
Barium iodide—10 mg
Phthalazinone—15 mg
2,2'-Methylenebis(4-ethyl-6-tert-butylphenol)—25 mg For comparison, ingredients [VII] or [VIII] as shown below was each added to 1.5 g of the same silver behenate suspension [A], and the resulting silver behenate emulsion containing no iodine was applied onto the polyester film in the same manner as described above and air-dried at room temperature to obtain a comparative dry image forming material.

Ingredients [VII]

The same polyvinyl butyral solution as in ingredients[VI]—1.0 g
Barium iodide—10 mg
Phthalazinone—15 mg
2,2'-Methylenebis(4-ethyl-6-tert-butylphenol)—25 mg Ingredients [VIII]

The same polyvinyl butyral solution as in ingredients [VI]—1.0 g
Barium iodide—30 mg
Phthalazinone—15 mg
2,2'-Methylenebis(4-ethyl-6-tert-butylphenol)—25 mg For comparison with the material prepared using the ingredients [VI], another dry image forming material was prepared using the following ingredients [IX] without the halogen ion source in the same manner as described above.

Ingredients [IX]

The same polyvinyl butyral solution as in ingredients [VI]—1.0 g
Iodine—14 mg
Phthalazinone—15 mg
2,2'-Methylenebis(4-ethyl-6-tert-butylphenol)—25 mg Each of the so obtained dry image forming materials was heated on a hot plate maintained at about 100° C. for 5 seconds in a dark room to render it photosensitive, and was then closely contacted with a mask film and exposed to light from a 150-watt xenon lamp for 1/15 seconds. Then, the exposed material was heated on a hot plate maintained at about 120° C. for about 5 seconds in the dark. In each case, a negative image was developed during heating.

On the other hand, when each of the dry image forming materials was exposed to light from a 150-watt xenon lamp for 1 minute without preliminary heating and heated on a hot plate maintained at about 120° C. for about 10 seconds in the dark, no image was developed in the case of the image forming materials obtained using the respective ingredients [VI] and [IX], but in the case of the image forming materials obtained using the respective ingredients [VII] and [VIII], images similar to those obtained with preliminary heating were obtained.

Characteristics of the so obtained images are shown in Table 3.

Table 3

| Number of Ingredients Used for Image Forming Material | Maximum Optical Density (O.D. max) | Minimum Optical Density (O.D. min) | Remarks |
|---|---|---|---|
| [VI] | 1.39 | 0.06 | this invention |
| [VII] | 0.21 | 0.19 | comparative |
| [VIII] | 0.35 | 0.35 | " |
| [IX] | 0.31 | 0.06 | this invention |

From the results shown in Table 3, it is apparent that the fog density is remarkably low in the image forming materials prepared using the respective ingredients [VI] and [IX] each containing $I_2$. Also, it is apparent that the effect attained by incorporation of $I_2$ is different from and more than the effect attained merely by increasing the amount of the halogen ion source and that the sensitivity is prominently enhanced by the combined use of $I_2$ and the halogen ion source.

EXAMPLE 13 AND COMPARATIVE EXAMPLE 3

In order to examine the lesser fogging and the storage stability, before use, of the dry image forming material of this invention, emulsions composed of respective ingredients [X], [XI] and [XII] were prepared, applied onto the polyester film and dried in the same manner as described in Example 1.

Ingredients [X] (this invention)

Silver behenate suspension (A) prepared in Example 1—1.5 g
Polyvinyl butyral solution as used in Example 1—1.0 g
Mercury acetate—0.1 mg
Iodine—14 mg
Tetraethylammonium iodide—2 mg Ingredients [XI] (comparative)

Silver behenate solution [A] prepared in Example 1—1.5 g
Polyvinyl butyral solution as used in Example 1—1.0 g
Mercury acetate—0.1 mg
Tetraethylammonium iodide—2 mg Ingredients [XII] (comparative)

Silver behenate suspension [A] prepared in Example 1—1.5 g
Polyvinyl butyral solution as used in Example 1—1.0 g
Mercury acetate—2 mg
Tetraethylammonium iodide—2 mg About 2 g of the reducing layer-forming composition composed of ingredients [XIII] as shown below were uniformly applied as a second layer onto each of the so prepared silver behenate emulsion layers at an orifice of 100μ and air-dried at room temperature (20° C.) to form an image forming material having a total coating layer thickness of about 12μ.

Ingredients [XIII]

Cellulose acetate—6.3 g
2,2'-Methylenebis(4-methyl-6-tert-butylphenol)—3.4 g
Phthalazinone—1.4 g
Acetone—83 g Each of the so obtained dry image forming materials was heated on a hot plate maintained at about 100° C. for 5 seconds in a dark room to render it photosensitive, and then closely contacted with a mask film and exposed to light from a 150-watt xenon lamp for ⅓ second. When the exposed material was heated on a hot plate maintained at 120° C. for 5 seconds in the dark, a negative image was obtained.

In order to examine the stability of the raw image forming material, each material was light-exposed in a xenon fadeometer XF-1 (trade name of a fadeometer manufactured and sold by Suga Shikenki Co., Japan) for a given time and an image was formed in the same manner as described above. Changes of image characteristics with the lapse of time were determined. The obtained results are shown in Table 4.

Table 4

| Number of Ingredients Used for Image forming Material | O.D. max/O.D. min | O.D. max/O.D. min after Fadeometer Test: 15 minutes | 30 minutes | 2 hours | Remarks |
|---|---|---|---|---|---|
| [X] | 1.21/0.06 | 1.22/0.07 | 1.22/0.09 | 1.23/0.09 | this invention |
| [XI] | 0.63/0.22 | 1.18/1.03 | 4/4 | — | comparative |
| [XII] | 0.32/0.13 | 0.58/0.36 | 2.60/2.43 | 4/4 | " |

From the results shown in Table 4, it is apparent that the image forming material of this invention has a high sensitivity with less fog and it should further be noted that to the advantage of the image forming material of this invention, a high stability can be obtained even if mercury acetate is used in a very small amount.

EXAMPLE 14

An emulsion was prepared adding successively ingredients [XIV] as shown below to 1.5 g of the silver behenate suspension [A] prepared in Example 1, and the emulsion was applied onto the polyester film and dried in the same manner as described in Example 1.

Ingredients [XIV]

Polyvinyl butyral solution as used in Example 1—1.0 g
Mercury acetate—0.1 mg

Triphenylphosphite nonaiodide ( 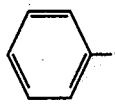 —O)$_3$P.I$_9$ 18 mg

A reducing layer composed of the ingredients [XIII] as used in Example 13 was formed in the same manner as in Example 13 to prepare an image forming material having a total coating layer thickness of about 12μ.

The so obtained image forming material was heated at 100° C. for about 3 seconds in the dark to render it photosensitive, and then exposed to light from a 150-watt xenon lamp for 1/60 second and heat-developed at 120° C. for 5 seconds. A clear image characterized by a maximum optical density of 1.31 and a fog density of 0.05 was obtained. The raw image forming material had a very high stability which was seen in that even when the raw material light-exposed in the fadeometer for 2 hours, followed by image formation, the change of the image characteristics were not observed at all.

The emulsion containing triphenylphosphite nonaiodide in this Example is especially excellent in stability and hence, has a very high industrial value on manufacture of dry image forming materials.

EXAMPLES 15 to 22

Ingredients [XV] as shown below were successively added to 1.5 g of the silver behenate suspension [A] prepared in Example 1 to form a light yellow silver behenate emulsion. The emulsion was uniformly applied onto a 100μ-thick polyester film at an orifice of 100μ and air-dried at room temperature (about 20° C.) to obtain an image forming material having a dry coating layer thickness of about 8μ. The preparation of this image forming material was carried out in a light room all the time.

Ingredients [XV]

Solution of 7.2 g of polyvinyl butyral in 80 g of methyl ethyl ketone—1.0 g
Iodine (finely pulverized in an agate mortar)—16 mg
Phthalazinone—15 mg
2,2'-Methylenebis(4-ethyl-6-tert-butylphenol)—25 mg
Nickel and/or cobalt compound—indicated in Table 5

The kind and amount of the cobalt and/or nickel compound incorporated into the dry image forming material and characteristics of the obtained image forming material are shown in Table 5.

Each of the so obtained dry image forming materials was heated on a hot plate maintained at about 100° C. for about 5 seconds to render it photosensitive, and then closely contacted with a mask film and exposed to light from a 150-watt xenon lamp for about 1 second. Then, the so light-exposed material was heated on a hot plate maintained at about 120° C. for about 5 seconds in the dark. In each case, a negative image was gradually developed during heating.

In order to examine the stabilities of the so prepared raw image forming materials, they were subjected to accelerated stability tests using the fadeometer (accelerated light stability test at room temperature) and a thermo-hygrostat (heat- and humidity-stability test at a temperature of 45° C. and a relative humidity of 80%). After the accelerated tests, each material was preliminarily heated to render it photosensitive, exposed to light and heat-developed in the same manner as described above. The obtained results are shown in Table 5.

Table 5

| Example No. | Cobalt and/or Nickel Compound Kind | Amount | Dry Image Forming Material: Just after Preparation O.D. max | O.D. min | After Placed in Fadeometer for 4 Hours O.D. max | O.D. min | After Placed in Thermo-hygrostat for 48 Hours O.D. max | O.D. min |
|---|---|---|---|---|---|---|---|---|
| 15 | Acetylacetonato-cobalt(III) | 5 mg | 1.24 | 0.06 | 1.30 | 0.07 | 1.36 | 0.09 |
| 16 | Acetylacetonato-cobalt (III) | 2 mg | 1.30 | 0.06 | 1.32 | 0.07 | 1.32 | 0.10 |
| 17 | Acetylacetonato-nickel (II) | 5 mg | 1.07 | 0.06 | 1.06 | 0.10 | 1.07 | 0.06 |
| 18 | Acetylacetonato-nickel (II) | 1 mg | 1.12 | 0.06 | 1.11 | 0.10 | 1.09 | 0.06 |
| 19 | Tris(8-hydroxyquino-lato)cobalt(III) | 5 mg | 1.20 | 0.06 | 1.22 | 0.07 | 1.21 | 0.11 |
| 20 | Acetylacetonato-cobalt(III) | 3 mg | | | | | | |
| | | | 1.13 | 0.06 | 1.12 | 0.07 | 1.13 | 0.06 |
| | Acetylacetonato-nickel(II) | 1 mg | | | | | | |
| 21 | Cobalt (II) perchlorate | 5 mg | 1.28 | 0.07 | 1.32 | 0.07 | 1.30 | 0.09 |
| 22 | Nickel (II) perchlorate | 5 mg | 1.33 | 0.07 | 1.31 | 0.09 | 1.27 | 0.07 |

In Table 5, O.D. max indicates the maximum optical density, and O.D. min indicates the minimum optical density (fog density).

EXAMPLES 23 AND 24

In the same manner as described in Examples 15 to 22, dry image forming materials were prepared using cobaltous bromide and nickelous iodide, respectively, instead of the cobalt and nickel compounds used in Examples 15 to 22.

Each of the obtained materials was heated on a hot plate maintained at about 100° C. for 5 seconds, then closely contacted with a mask film and exposed to light from a 150-watt xenon lamp for 1/15 second. Each of the light-exposed materials was heated on a hot plate maintained at 120° C. for 5 seconds to gradually develop a negative image.

With the purpose of examining the stability of the raw image forming material, the materials were subjected to the accelerated tests using the fadeometer and the thermo-hygrostat in the same manner as described in Examples 15 to 22, followed by preliminary heating, light exposure and heat development in the same manner as described above. The obtained results are shown in Table 6.

Table 6

| Example No. | Nickel or Cobalt Salt Kind | Amount | Dry Image Forming Material: Just after Preparation O.D. max | O.D. min | After Placed in Fadeometer for 4 Hours O.D. max | O.D. min | After Placed in Thermo-hygrostat for 48 Hours O.D. max | O.D. min |
|---|---|---|---|---|---|---|---|---|
| 23 | Cobaltous bromide | 3 mg | 1.65 | 0.06 | 1.58 | 0.08 | 1.71 | 0.08 |
| 24 | Nickelous iodide | 1 mg | 1.59 | 0.05 | 1.55 | 0.08 | 1.61 | 0.06 |

Emulsions of Examples 23 and 24 have a great significance from the industrial viewpoint because the preparations thereof is very easy and their emulsion stabilities are very high.

EXAMPLES 25 and 26

0.2 mg of mercury acetate or 2 mg of tetrachlorophthalic anhydride was each added as an anti-foggant of heat development to the emulsion prepared in Example 23. The development characteristics of the obtained dry image forming materials were examined.

The preliminary heating was carried out on a hot plate maintained at 100° C. for 5 seconds, and light exposure was carried out under the same conditions as in Examples 23 and 24. The obtained results are shown in Table 7.

Table 7

| Example No. | Anti-Foggant | Development Conditions: 120° C., 5 seconds O.D. min | O.D. max | 120° C., 15 seconds O.D. min | O.D. max | 130° C., 5 seconds O.D. min | O.D. max |
|---|---|---|---|---|---|---|---|
| 23 | Not added | 0.06 | 1.65 | 0.07 | 1.79 | 0.10 | 1.90 |
| 25 | Mercury acetate | 0.06 | 1.59 | 0.06 | 1.63 | 0.08 | 1.70 |
| 26 | Tetrachloro-phthalic anhydride | 0.05 | 1.59 | 0.06 | 1.61 | 0.07 | 1.64 |

From the results shown in Table 7, it will readily be understood that an image forming material containing tetrachlorophthalic anhydride as an anti-foggant of heat development is excellent in that the applicable range of development conditions is broad.

What is claimed is:

1. A dry image forming material capable of forming an image by preliminary heating, imagewise exposure to light, and heat development thereof, said material comprising (a) a non-photosensitive organic silver salt oxidizing agent, (b) a reducing agent for a silver ion and (c) at least one halogen molecule selected from the group consisting of a bromine molecule, an iodine molecule, iodine chlorides, iodine bromide and bromine chloride.

2. A dry image forming material as claimed in claim 1, which further comprises at least one halogen ion source in addition to said at least one halogen molecule.

3. A dry image forming material as claimed in any of claims 1 and 2, which further comprises at least one metallic compound selected from the group consisting of cobalt compounds and nickel compounds.

4. A dry image forming material as claimed in claim 1, which further comprises at least one compound selected from the group consisting of nickel chlorides, nickel bromides, nickel iodides, cobalt chlorides, cobalt bromides and cobalt iodides.

5. A dry image forming material as claimed in any of claims 1, 2 or 4 wherein said halogen molecule is an iodine molecule.

6. A dry image forming material as claimed in claim 1 which further comprises at least one carboxylic acid anhydride.

7. A dry image forming material as claimed in any of claims 1, 2 or 4, wherein the non-photosensitive organic silver salt oxidizing agent is a long-chain fatty acid silver salt.

8. A dry image forming material as claimed in claim 6, wherein said carboxylic acid anhydride is tetrachlorophthalic anhydride.

* * * * *